US008294345B2

(12) United States Patent
Yoshida et al.

(10) Patent No.: US 8,294,345 B2
(45) Date of Patent: Oct. 23, 2012

(54) SPARK PLUG AND RESISTOR COMPOSITION

(75) Inventors: Haruki Yoshida, Aichi (JP); Keita Nakagawa, Aichi (JP); Tsutomu Shibata, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 10 days.

(21) Appl. No.: 13/126,850

(22) PCT Filed: Oct. 30, 2009

(86) PCT No.: PCT/JP2009/005778

§ 371 (c)(1),
(2), (4) Date: Apr. 29, 2011

(87) PCT Pub. No.: WO2010/052875

PCT Pub. Date: May 14, 2010

(65) Prior Publication Data

US 2011/0204766 A1 Aug. 25, 2011

(30) Foreign Application Priority Data

Nov. 4, 2008 (JP) ..... 2008-283119

(51) Int. Cl.
*H01T 13/20* (2006.01)
*F02M 57/06* (2006.01)

(52) U.S. Cl. ..... 313/141; 313/118

(58) Field of Classification Search ..... None
See application file for complete search history.

(56) References Cited

U.S. PATENT DOCUMENTS

| | | | | | |
|---|---|---|---|---|---|
| 3,226,342 | A | * | 12/1965 | Kesten | 313/118 |
| 3,567,658 | A | * | 3/1971 | Webb et al. | 313/136 |
| 3,931,055 | A | * | 1/1976 | Friese | 252/503 |
| 4,601,848 | A | | 7/1986 | Sakai et al. | |
| 6,160,342 | A | | 12/2000 | Nishikawa et al. | |

FOREIGN PATENT DOCUMENTS

| | | | |
|---|---|---|---|
| JP | 57-60761 | B2 | 12/1982 |
| JP | 60-150602 | A | 8/1985 |
| JP | 2005-327743 | A | 11/2005 |

* cited by examiner

*Primary Examiner* — Anh Mai
*Assistant Examiner* — Britt D Hanley
(74) *Attorney, Agent, or Firm* — Sughrue Mion, PLLC

(57) ABSTRACT

A spark plug (100) has a resistor (15) between a center electrode 3 and a metal terminal (13). The resistor (15) contains glass, ceramic powder, an electrically conductive material, and metal. An average of two or more particles of the metal are present in an arbitrary region measuring 300 (μm)×300 (μm) on an arbitrary section of the resistor (15), and the total sectional area of the metal present in the region accounts for less than 1.6% of the region.

7 Claims, 1 Drawing Sheet

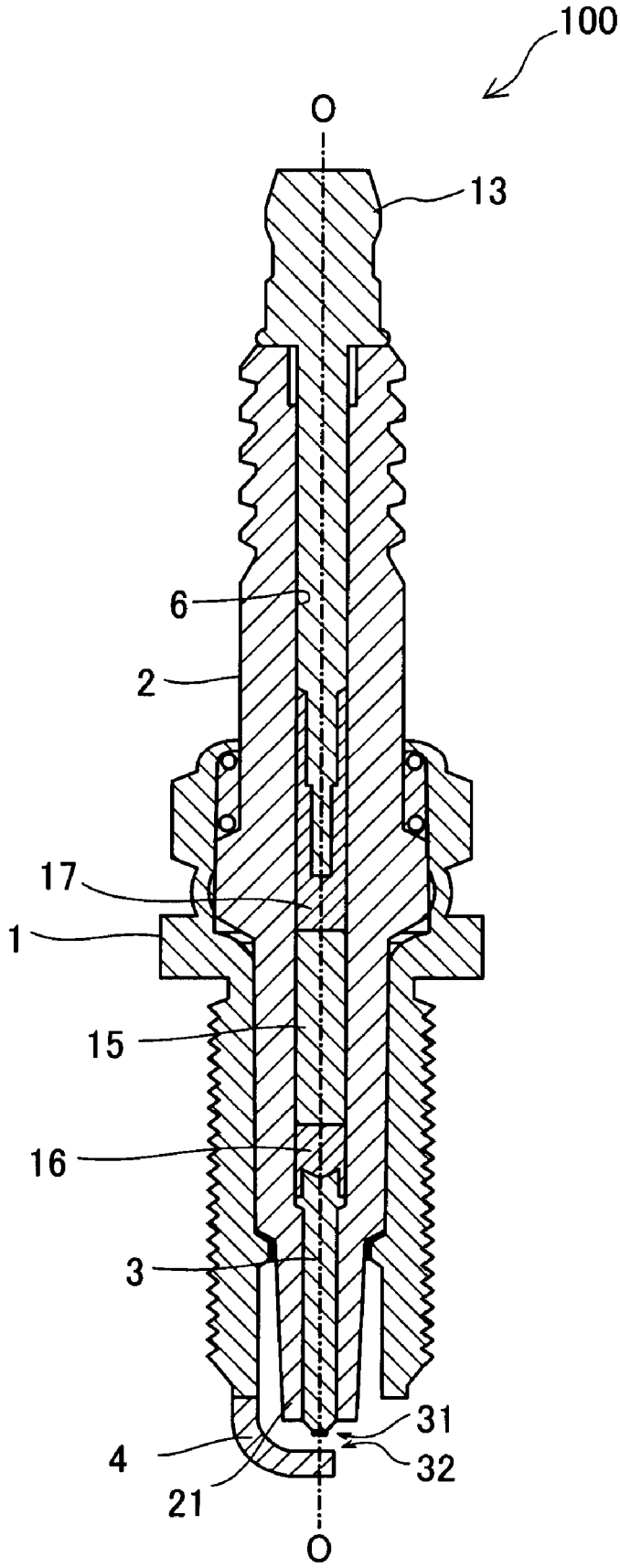
100
O
13
6
2
17
1
15
16
3
31
4
32
21
O

SPARK PLUG AND RESISTOR COMPOSITION

CROSS REFERENCE TO RELATED APPLICATIONS

This application is a National Stage of International Application No. PCT/JP2009/005778 filed Oct. 30, 2009, claiming priority based on Japanese Patent Application No. 2008-283119 filed Nov. 4, 2008, the contents of all of which are incorporated herein by reference in their entirety.

TECHNICAL FIELD

The present invention relates to a resistor-incorporated spark plug.

BACKGROUND ART

Conventionally, in order to restrain the generation of radio-wave noise caused by spark discharges of a spark plug, a resistor-incorporated spark plug in which a resistor is disposed between a center electrode and a metal terminal has been widely used. Under certain conditions of use, such a resistor-incorporated spark plug has exhibited the emergence of a phenomenon of increase in resistance of the resistor due to oxidation of carbon contained in the resistor caused by electric energy which flows through the resistor. In order to cope with the phenomenon, for example, Patent Documents 1 and 2 mentioned below disclose restraint of oxidation of carbon through addition of metal powder having reducing action to the resistor for improving under-load life.

PRIOR ART DOCUMENT

Patent Document

Patent Document 1: Japanese Patent Application Laid-Open (kokai) No. S60-150601

Patent Document 2: Japanese Patent Application Laid-Open (kokai) No. S60-150602

However, even in the case of addition of metal powder in those amounts described in Patent Documents 1 and 2, a spark plug having a certain shape has failed to sufficiently improve under-load life.

SUMMARY OF THE INVENTION

Problems to be Solved by the Invention

In view of the above problem, an object of the present invention is to improve under-load life of a resistor-incorporated spark plug in which metal powder is added to a resistor.

Means For Solving the Problems

To at least partially solve the above problem, the present invention can be embodied in the following modes or application examples.

APPLICATION EXAMPLE 1

A spark plug having a resistor between a center electrode and a metal terminal, wherein the resistor contains glass, ceramic powder, an electrically conductive material, and metal; and an average of two or more particles of the metal are present in an arbitrary region measuring 300 (μm)×300 (μm) on an arbitrary section of the resistor, and the total sectional area of the metal present in the region accounts for less than 1.6% of the region.

According to the spark plug of the above mode, the metal powder is dispersed appropriately within the resistor, whereby, even upon oxidation of the metal powder, significant shutoff of electric current is restrained. As a result, under-load life of the spark plug can be improved.

APPLICATION EXAMPLE 2

A spark plug according to application example 1, wherein the total sectional area of the metal present in the region accounts for 0.01% to 1.3% inclusive of the region.

APPLICATION EXAMPLE 3

A spark plug according to application example 1, wherein the total sectional area of the metal present in the region accounts for 0.02% to 1.0% inclusive of the region.

APPLICATION EXAMPLE 4

A spark plug according to any one of application examples 1 to 3, wherein at least one or more of Al (aluminum), Zn (zinc), Fe (iron), Cu (copper), Mg (magnesium), Sn (tin), Ti (titanium), Zr (zirconium), Ag (silver), and Ga (gallium) are contained as the metal.

APPLICATION EXAMPLE 5

A spark plug according to any one of application examples 1 to 4, wherein the ceramic powder contains $ZrO_2$ (zirconia).

APPLICATION EXAMPLE 6

A spark plug according to any one of application examples 1 to 5, wherein the electrically conductive material is carbon black.

APPLICATION EXAMPLE 7

A spark plug according to any one of application examples 1 to 6, wherein the composition of the glass contains at least one or more of B (boron), Si (silicon), Ba (barium), Ca (calcium), Sn (tin), and Ti (titanium), and the glass has a deformation point not lower than 300° C. but lower than 700° C.

The present invention can be embodied not only in the above-mentioned spark plug but also in a method for manufacturing a spark plug and in a resistor used in a spark plug.

BRIEF DESCRIPTION OF THE DRAWINGS

FIG. 1 Sectional view of a spark plug 100 according to an embodiment of the present invention.

MODES FOR CARRYING OUT THE INVENTION

FIG. 1 is a sectional view of a spark plug 100 according to an embodiment of the present invention. The spark plug 100 includes a tubular metallic shell 1; an insulator 2 which is fitted into the metallic shell 1 such that a tip portion 21 projects from an end portion of the metallic shell 1; a center electrode 3 which is provided in the insulator 2 such that a spark portion 31 formed at the tip thereof projects from the insulator 2; and a ground electrode 4 whose one end is joined to the metallic shell 1 by welding or the like and whose portion extending toward the other end is bent such that the side surface of the other end portion faces the spark portion 31 of the center electrode 3. The ground electrode 4 has a spark portion 32 formed at a position which faces the spark portion 31. A gap between the spark portion 31 and the spark portion 32 serves as a spark discharge gap.

The insulator 2 has a through hole 6 formed therein along an axis O; a metal terminal 13 is fixed in one end portion of the through hole 6; and the center electrode 3 is fixed in the other end portion of the through hole 6. A resistor 15 is disposed in the through hole 6 between the metal terminal 13 and the center electrode 3. Opposite end portions of the resistor 15 are electrically connected to the center electrode 3 and the metal terminal 13 via electrically conductive glass seal layers 16 and 17, respectively.

The resistor 15 in the present embodiment is formed by use of glass, ceramic powder, an electrically conductive material, metal powder, and binder (adhesive). An average of two or more particles of the metal powder are present in an arbitrary region measuring 300 (μm)×300 (μm) (hereinafter, the region is referred to as the "analysis region") on an arbitrary section of the resistor 15. Also, the total sectional area of the metal powder present in the analysis region accounts for less than 1.6% of the analysis region. As for the metal powder, for example, a metal powder which contains one or more metals of Al, Zn, Fe, Cu, Mg, Sn, Ti, Zr, Ag, and Ga can be used. Preferably, a metal powder which contains one or more metals of Al, Zn, Fe, Cu, and Mg is used; more preferably, a metal powder which contains one or more metals of Al, Fe, and Mg is used. Far more preferably, a metal powder which contains Al is used. As for the ceramic powder, a ceramic powder which contains $ZrO_2$ can be used. Also, glass whose composition contains at least one or more of B, Si, Ba, Ca, Sn, and Ti can be employed. Further, carbon black can be used as the electrically conductive material.

In the spark plug 100, assembly of the center electrode 3 and the metal terminal 13 to the insulator 2 and formation of the resistor 15 and the electrically conductive glass seal layers 16 and 17 can be performed as follows. First, the center electrode 3 is inserted into the through hole 6 of the insulator 2. Subsequently, electrically conductive glass powder used to form the electrically conductive glass seal layer 16, the above-mentioned material for the resistor 15, and electrically conductive glass powder used to form the electrically conductive glass seal layer 17 are sequentially charged into the through hole 6. Next, the metal terminal 13 is inserted into the through hole 6. Then, the entire insulator 2 is heated to a temperature of 900° C. to 1,000° C., and a predetermined pressure is applied from a side toward the metal terminal 13. By this procedure, the materials are compressed and sintered, thereby forming the electrically conductive glass seal layers 16 and 17 and the resistor 15 in the through hole 6.

On the basis of the embodiment described above, 15 kinds of spark plugs 100 having relatively small diameters of the through hole 6 of 2.5 mm and 2.9 mm were fabricated while the amount of addition of metal powder to the resistor 15 was varied. The spark plugs 100 were subjected to an experiment on under-load life. Table 1 shows the results of the experiment.

TABLE 1

| | | Metal powder | | | EPMA measurement | | Results | |
|---|---|---|---|---|---|---|---|---|
| | Seal dia. (mm) | Type | Av. part. size (μm) | Amount of addition (wt. % in non-glass material) | Metal qty (300 μm × 300 μm region | Metal p.c. (%) | P.c. of change of R val. (%) | Judgment |
| Comparative Example 1 | 2.5 | Al | 32 | 0.6 | 0.2 | 0.1 | +115 | Poor |
| Comparative Example 2 | 2.9 | Al | 32 | 0.6 | 0.2 | 0.1 | +111 | Poor |
| Comparative Example 3 | 2.5 | Al | 32 | 15.0 | 5 | 4.5 | +500 | Poor |
| Comparative Example 4 | 2.5 | Al | 6 | 6.0 | 50 | 1.6 | +106 | Poor |
| Example 1 | 2.5 | Al | 4 | 0.1 | 2 | 0.02 | −8 | Good |
| Example 2 | 2.5 | Al | 6 | 0.4 | 3.3 | 0.1 | −6 | Good |
| Example 3 | 2.5 | Al | 6 | 0.6 | 5 | 0.2 | −6 | Good |
| Example 4 | 2.9 | Al | 6 | 0.6 | 5 | 0.2 | −13 | Good |
| Example 5 | 2.5 | Al | 6 | 1.2 | 10 | 0.3 | +5 | Good |
| Example 6 | 2.5 | Al | 6 | 1.8 | 15 | 0.5 | +25 | Good |
| Example 7 | 2.5 | Al | 6 | 3.6 | 30 | 1.0 | +58 | Good |
| Example 8 | 2.5 | Mg | 6 | 0.6 | 5 | 0.2 | +10 | Good |
| Example 9 | 2.5 | Fe | 6 | 0.6 | 5 | 0.2 | +15 | Good |
| Example 10 | 2.5 | Cu | 6 | 0.6 | 5 | 0.2 | +30 | Good |
| Example 11 | 2.5 | Zn | 6 | 0.6 | 5 | 0.2 | +27 | Good |

This experiment employed Al, Mg, Fe, Cu, and Zn powders as metal powder to be added to the resistor 15, and other materials were blended in amounts shown below. The amount of metal powder to be added was adjusted through replacement of a portion of ceramic powder with metal powder. In the following description, the term "non-glass material" refers to material remaining after removal of glass from the aforementioned material for the resistor 15; specifically, ceramic powder, electrically conductive material, metal, and binder.

Glass ($B_2O_3$: 29%; $SiO_2$: 50%; BaO: 17%; $Li_2O_3$: 4%): 600 wt. % with respect to 100 wt. % of non-glass material Ceramic powder ($ZrO_2$): 72.2 to 87.1 wt. % the non-glass material (the value varies because of replacement with metal powder)

Electrically conductive material (carbon black): 10 wt. % the non-glass material Binder (dextrin): 2.8 wt. % the non-glass material In this experiment, the spark plugs 100 were caused to perform discharge at a rate of 3,600 discharges per minute for 250 hours through application of a discharge voltage of 20 kV at an ambient temperature of 350° C. The spark plugs 100 were measured for resistance R after the experiment. To what degree the resistance R had changed in relation to an initial resistance measured before discharge was obtained through averaging of values obtained from 10 repetitions of the experiment. The degree of change appears as "percentage of change" in Table 1. A percentage of change of +100% or greater was judged "poor," and a percentage of change of less than +100% was judged "good." The spark plugs 100 judged "good" are small in percentage of change of resistance and have sufficient under-load life.

The term "metal quantity" appearing in Table 1 refers to the number of metal particles present in the aforementioned analysis region of the resistor 15. The term "metal percentage" appearing in Table 1 refers to percentage of the analysis region which the total of sectional areas (total sectional area) of individual metal particles present in the analysis region accounts for. Metal quantity and metal percentage can be obtained by use of an EPMA (Electron Probe Micro Analyzer). Specifically, the present experiment employed, as an EPMA, the apparatus JXA-8500F, a product of JEOL DATUM. The apparatus was set to an acceleration voltage of 20 kV, an irradiation current of $(5\pm0.5)\times10^{-8}$ A, an effective time of 10 msec, a measuring interval of 1 μm, and a field of view of 300 μm×300 μm. An image within a field of view was binarized according to whether the number of counts under the setting was 100 or greater, or less than 100. The binarized image was computer-analyzed for obtaining metal quantity and metal percentage. Metal quantity and metal percentage appearing in Table 1 are averages of five repetitions of the analysis of an arbitrary field of view. For measurement of the number of metal particles and the area of metal particles, the image analysis software analySIS Five (trademark), a product of Soft Imaging System GmbH, was used. When it was apparent through visual observation that two particles in contact with each other on a measurement screen were counted as one, the interface between the two particles was image-processed so as to separate the two particles, whereby the particles were counted individually.

Referring to the results of experiment shown in Table 1, for example, in the spark plugs of Comparative Examples 1 and 2 having seal diameters of 2.5 mm and 2.9 mm, respectively, Al powder having an average particle size of 32 μm was added in an amount of 0.6 wt. % as meal powder. As a result, Al quantity in the analysis region of the resistor 15 became as small as 0.2. Consequently, in Comparative Examples 1 and 2, the percentage of change of resistance R exceeded +100%, and no improvement in under-load life was observed.

Examples 3 and 4 underwent the experiment under the same conditions as those of Comparative Examples 1 and 2 except that the average particle size of Al powder to be added was reduced from 32 μm to 6 μm. In Examples 3 and 4, the amount of addition (wt. %) of Al particles was the same as that of Comparative Examples 1 and 2. However, as a result of reduction in average particle size of Al particles, Al quantity increased from 0.2 to 5. That is, as compared with Comparative Examples 1 and 2, in Examples 3 and 4, finer Al particles are dispersed in the resistor 15. In this manner, as a result of reduction in particle size of Al powder to thereby increase the number of Al particles per unit area, as shown in Table 1, Examples 3 and 4 exhibited a reduction in percentage of change of resistance R to −6% and −13%, respectively, indicating improvement in under-load life.

Example 1 employed finer Al powder (average particle size=4 μm) and an amount of addition of Al powder of 0.1 wt. % and thus had the resistor 15 having two Al particles in the analysis region and an Al percentage of 0.02%. In Example 1, the percentage of change of resistance R was reduced to −8, and an improvement in under-load life was observed. That is, reducing the particle size of Al powder is advantageous to under-load life. Conceivably, this is because, in the case of a large particle size of Al powder or an excessively large amount of addition, oxidized metal powder functions as an insulator, thereby significantly shutting off conductive paths in the resistor. Notably, experience of the applicant of the present invention shows that an amount of addition of Al powder of about 0.01 wt. % is advantageous to under-load life (refer to Japanese Patent Application Laid-Open (kokai) Nos. S60-150601 and S60-150602).

In Comparative Example 3, Al quantity was five, which does not much differ from those of other Examples; however, Al percentage was 4.50%, which is significantly large. This is for the following reason: the amount of addition of Al powder was 15 wt. %, which was significantly large as compared with those of other Examples and Comparative Examples, and Comparative Example 3 employed Al powder having a relatively large particle size; specifically, an average particle size of 32 μm. As a result, Comparative Example 3 exhibited a very high percentage of change of resistance R of +500%.

Examples 2, 5, 6, and 7 employed the same seal diameter and the same average particle size of Al powder, but employed slightly different amounts of addition of Al powder of 0.4 wt. %, 1.2 wt. %, 1.8 wt. %, and 3.6 wt. %, respectively. As a result, Al quantity gradually increased in the manner of 3.3, 10, 15, and 30, and Al percentage gradually increased in the manner of 0.1%, 0.3%, 0.5%, and 1.0%. With these values of Al quantity and Al percentage, their percentages of change of resistance R were all less than +100%, and a sufficient under-load life was observed.

Similar to other Examples, Comparative Example 4 employed Al powder having an average particle size of 6 μm. However, the amount of addition was made slightly larger (6.0 wt. %) than those of other Examples for increasing Al quantity (50) and Al percentage (1.6%); as a result, percentage of change of resistance R became +106%, which is slightly in excess of tolerance. That is, an Al percentage of about 1.6% can be considered an upper limit for ensuring under-load life. Example 7, which among Examples judged "good," exhibits the greatest percentage of change of resistance R, has an Al percentage of 1.0%, and Comparative Example 4 has an Al percentage of 1.60%; and Example 7 exhibits a percentage of change of resistance R of +58%, and Comparative Example 4 exhibits a percentage of change of +106%. In view of this, a more preferred upper limit of Al percentage can be considered an intermediate value of about 1.30 between the Al percentage of Example 7 and that of Comparative Example 4. Among Examples mentioned above, Example 1 has a lowest Al percentage of 0.02%. However, even when Al percentage is about 0.01%, improvement in under-load life can be expected if Al quantity is two or more.

Comparative Examples 1 to 4 and Examples 1 to 7 mentioned above employed Al powder as metal powder used to form the resistor 15. By contrast, Examples 8, 9, 10, and 11 employed, as metal powder, Mg powder, Fe powder, Cu powder, and Zn powder, respectively. Similar to Example 3, in Examples 8 to 11, the seal diameter was set to 2.5 mm; metal powder having an average particle size of 6 μm was employed; and the amount of addition of metal powder was set to 0.6%. As a result, in Examples 8 to 11, similar to Example 3, metal quantity was five, and metal percentage was 0.2%. The percentages of change of resistance R were +10% in Example 8, +15% in Example, 9, +30% in Example 10, and +27% in Example 11, which were all less than +100%, indicating achievement of sufficient under-load life. That is, even when Mg, Fe, Cu, Zn, etc. are used in place of Al, under-load life can be improved. As for the metal powder, in addition to these metals, other metals having reducing action; for example, Sn, Ti, Zr, Ag, and Ga, may be employed. Also, metal powder may contain two or more metals having reducing action.

As described above, in view of the results of experiment shown in Table 1, as in the case of Examples 1 to 7, even spark plugs having relatively small seal diameters, such as 2.5 mm and 2.9 mm, can exhibit improvement in under-load life if the following conditions are satisfied: an average of two or more metal particles are present in an analysis region measuring 300 μm×300 μm on an arbitrary section of the resistor 15, and the total sectional area of metal present in the analysis region accounts for less than 1.6%, preferably 0.01% to less than 1.3%, more preferably 0.02% to 1.0% inclusive of the analysis region.

As for ceramic powder used as a component of material for the resistor 15, from the viewpoint of electrical characteristics, ceramic powder which contains $ZrO_2$ is preferred, and $TiO_2$ (titanium oxide) may be added to the ceramic powder. The average particle size of ceramic powder is preferably 300 μm or less, more preferably 200 μm or less.

distinguished accurately by the following method. First, by use of EPMA (JXA-8500F), the percentage (mol %) of O and the percentage (mol %) of Al contained in a metal particle observed by the aforementioned method are measured. The ratio of the percentage of Al to the percentage of O (=Al/O) is calculated. Table 2 shows the results of the calculation for a plurality of cases where the resistor 15 contains Al and a plurality of cases where the resistor 15 contains alumina. Referring to Table 2, in the cases where metal particles are of Al, the Al/O value is 2 or greater; and in the cases where metal particles are of alumina, the Al/O value is less than 2. That is, it can be distinguished that the resistor 15 contains Al, rather than alumina, as follows. The percentages (mol %) of Al and O contained in a metal particle are measured. If Al is present in an amount of two times or more that of O, the metal particle can be identified as an Al particle. This is because, in the case of use of Al as metal powder, in a heating-pressurizing process (glass seal process) in the course of manufacture of the spark plug 100, an oxide film is formed on the surfaces of Al particles contained in the resistor 15; as a result, oxidation does not progress inwardly, so that the percentage of Al increases. Also, in the case of use, as metal powder, of metal other than Al, such as Mg, Fe, Cu, or Zn, the percentage of such a metal contained in a metal particle becomes two times or more the percentage of O as in the case of use of Al. Therefore, the use of Mg, Fe, Cu, Zn, etc. as metal powder can also be distinguished by a method similar to that described above.

TABLE 2

| | Metal Al | | | | | $Al_2O_3$ (alumina) | |
|---|---|---|---|---|---|---|---|
| O (mol %) | 13.93 | 13.42 | 23.93 | 14.51 | 12.72 | 43.41 | 43.96 |
| Al (mol %) | 80.48 | 80.42 | 69.92 | 80.79 | 82.14 | 52.3 | 51.9 |
| Al/O | 5.777459 | 5.992548 | 2.921855 | 5.567884 | 6.457547 | 1.204792 | 1.180619 |

As for glass used as a component of material for the resistor 15, glass having a deformation point of 300° C. to 700° C., such as $BaO$-$B_2O_3$ glass, $BaO$-$B_2O_3$—$SiO_2$ glass, $BaO$-$B_2O_3$—$SiO_2$-$R_2O$(RO) glass, Pb—$SiO_2$ glass, Pb—$B_2O_3$—$SiO_2$—$Al_2O_3$ glass, $B_2O_3$—$SiO_2$ glass, $B_2O_3$—$SiO_2$—$Al_2O_3$ glass, $B_2O_3$—$SiO_2$-$R_2O$ (RO) glass, and $B_2O_3$—$SiO_2$—$Al_2O_3$-$R_2O$(RO) glass, and preferably having a particle size of about 150 μm can be used. Generally, the degree of expansion of glass material is evaluated by the distance of movement of a detection member of a measuring apparatus when the glass material expands uniaxially and presses the detection member. The deformation point is a temperature at which glass material softens and fails to press the detection member.

As for an electrically conductive material used as a component of material for the resistor 15, a substance which is oxidized at a heat-sealing temperature can be used. Specifically, from the viewpoint of electrical characteristics, as in the case of Comparative Examples and Examples described above, the employment of carbon black is preferred.

As for a binder used as a component of material for the resistor 15, there can be used a sugar, such as sucrose, lactose, maltose, raffinose, glycose, xylol, dextrin, or methyl cellulose; or a water-soluble carbon-forming substance, such as an organic carbonaceous material formed of aliphatic hydrocarbon, such as ethylene glycol, glycerin, propylene glycol, polyethylene glycol, or polyvinyl alcohol.

Meanwhile, in a spark plug of a certain type, the resistor 15 contains alumina ($Al_2O_3$) as aggregate. Thus, the use of Al as metal powder in the experiment mentioned above can be

DESCRIPTION OF REFERENCE NUMERALS

1: metallic shell
2: insulator
3: center electrode
4: ground electrode
6: through hole
13: metal terminal
15: resistor
16: electrically conductive glass seal layer
17: electrically conductive glass seal layer
21: tip portion
31: spark portion
32: spark portion
100: spark plug

The invention claimed is:

1. A spark plug having a resistor between a center electrode and a metal terminal, wherein:

the resistor contains glass, ceramic powder, an electrically conductive material, and metal; and an average of two or more particles of the metal are present in an arbitrary region measuring 300 (μm)×300 (μm) on an arbitrary section of the resistor, and the total sectional area of the metal present in the region accounts for less than 1.6% of the region.

2. A spark plug according to claim 1, wherein the total sectional area of the metal present in the region accounts for 0.01% to 1.3% inclusive of the region.

3. A spark plug according to claim 1, wherein the total sectional area of the metal presents in the region accounts for 0.02% to 1.0% inclusive of the region.

4. A spark plug according to claim 1, wherein at least one or more of Al, Zn, Fe, Cu, Mg, Sn, Ti, Zr, Ag, and Ga are contained as the metal.

5. A spark plug according to claim 1, wherein the ceramic powder contains $ZrO_2$.

6. A spark plug according to claim 1, wherein the electrically conductive material is carbon black.

7. A spark plug according to claim 1, wherein the composition of the glass contains at least one or more of B, Si, Ba, Ca, Sn, and Ti, and the glass has a deformation point not lower than 300° C. but lower than 700° C.

* * * * *